US007865112B2

(12) United States Patent
Saito et al.

(10) Patent No.: US 7,865,112 B2
(45) Date of Patent: Jan. 4, 2011

(54) ELECTROPHOTOGRAPHIC PRINTER

(75) Inventors: Tomohiko Saito, Hitachinaka (JP); Tsukasa Onose, Hitachinaka (JP); Sho Sawahata, Hitachinaka (JP); Yukio Otome, Hitachinaka (JP); Jyun Ogino, Hitachinaka (JP)

(73) Assignee: Ricoh Company, Ltd., Tokyo (JP)

( * ) Notice: Subject to any disclaimer, the term of this patent is extended or adjusted under 35 U.S.C. 154(b) by 234 days.

(21) Appl. No.: 12/033,362

(22) Filed: Feb. 19, 2008

(65) Prior Publication Data

US 2008/0199213 A1 Aug. 21, 2008

(30) Foreign Application Priority Data

Feb. 19, 2007 (JP) ..... 2007-037982

(51) Int. Cl.
*G03G 15/00* (2006.01)
*G03G 15/02* (2006.01)

(52) U.S. Cl. ..... 399/117; 399/116; 399/159; 399/167

(58) Field of Classification Search ..... 399/116, 399/117, 159, 167; 492/47
See application file for complete search history.

(56) References Cited

U.S. PATENT DOCUMENTS 4,527,883 A * 7/1985 Kamiyama ..... 399/117
5,038,172 A 8/1991 Schreyer
5,364,202 A * 11/1994 Ettelbrueck ..... 403/322.1
5,878,310 A * 3/1999 Noda et al. ..... 399/117
6,072,468 A * 6/2000 Hocker et al. ..... 345/157
6,246,851 B1 * 6/2001 Tietze et al. ..... 399/159
6,556,796 B1 * 4/2003 Chavez et al. ..... 399/110
6,716,148 B1 * 4/2004 Fortin et al. ..... 492/47
6,771,915 B2 * 8/2004 Cais et al. ..... 399/90
6,862,990 B2 * 3/2005 Gottling et al. ..... 101/375
6,907,205 B2 * 6/2005 Himes et al. ..... 399/90
2004/0009011 A1 * 1/2004 Ehara ..... 399/167

FOREIGN PATENT DOCUMENTS

JP 02-502130 7/1990
WO WO 88/05931 8/1988

* cited by examiner

*Primary Examiner*—David M Gray
*Assistant Examiner*—Francis Gray
(74) *Attorney, Agent, or Firm*—Antonelli, Terry, Stout & Kraus, LLP.

(57) ABSTRACT

An electrophotographic printer capable of easily attaching and detaching a retaining means to retain the inside of a photoconductive drum to and from the photoconductive drum. A flange located on the extraction side of a photoconductive drum is provided with: a retaining means to support the photoconductive drum from the side of the inner circumferential face of the photoconductive drum. And an advance and retreat mechanism to advance and retreat the retaining means to and from the inner face of the photoconductive drum. The retaining means can be easily dismantled from the photoconductive drum by operating the advance and retreat mechanism, and thereafter extracting the flange from the photoconductive drum.

13 Claims, 5 Drawing Sheets

ELECTROPHOTOGRAPHIC PRINTER

CLAIM OF PRIORITY

The present application claims priority from Japanese application serial No. 2007-37982, filed on Feb. 19, 2007, the content of which is hereby incorporated by reference into this application.

BACKGROUND OF THE INVENTION

1. Field of the Invention

The present invention relates to an electrophotographic printer and in particular, an electrophotographic printer wherein an attachable and detachable mechanism of a photoconductive drum is improved.

2. Description of the Related Art

In general, the photoconductive drum of an electrophotographic printer is configured as disclosed in e.g. JP-A No. 502130/1990. The configuration is explained in reference to FIGS. 9 and 10.

A photoconductive drum 1, configured in a cylindrical shape, engages with the outer circumference of a first flange 3 fixed to a step formed between a drive shaft 2 and a small diameter part 2S of the drive shaft 2 on the side of an end of the cylinder in a electrophotographic printer. Meanwhile, the end on the other side of the cylinder engages with a second flange 4 attached to the small diameter part 2S of the drive shaft 2.

Then the photoconductive drum 1 is concentrically supported on the drive shaft 2 and firmly retained between the first flange 3 and the second flange 4. A tightening means 5 such as a nut screwed at an end of the small diameter part 2S tightens the first flange 3 and second flange 4. Also, the first flange 3 is integrally provided with plural ribs 3R that extend in the axial direction and the end of the ribs 3R is located close to the second flange at the time of tightening. The ribs 3R function as a guide means so that the photoconductive drum 1 may not contact peripheral devices when the photoconductive drum 1 is attached to or detached from the drive shaft 2.

In addition, a retaining means 6 is attached so as to contact plural portions located in the circumferential direction on the inner circumferential face of the photoconductive drum 1 in order to prevent distortion of the photoconductive drum 1. The retaining means 6 is provided with halved support pieces 6A and 6B having plural contact parts contacting the photoconductive drum 1. And spring members (not shown in the figures) to press the support pieces 6A and 6B into contact with the photoconductive drum 1 by spring pressure.

The electrophotographic printer has the retaining means inside the photoconductive drum and the photoconductive drum is replaced together with the retaining means when it is replaced. From the view point of resource conservation therefore, the retaining means has been discarded in vain.

To cope with the problem, it is one solution to reuse a retaining means by dismantling the retaining means from an old photoconductive drum and then attaching the dismantled retaining means to a new photoconductive drum at the time of the replacement of the photoconductive drums. However, photoconductive drums are replaced by end-users in almost all cases, furthermore special tools are used for detaching or attaching the retaining means from or to a photoconductive drum, and hence the replacement of the photoconductive drum is very difficult and needs a long time.

An object of the present invention is to provide an electrophotographic printer capable of easily attaching and detaching a retaining means to retain the inside of a photoconductive drum to and from the photoconductive drum.

SUMMARY OF THE INVENTION

In the present invention, in order to attain the above object, an electrophotographic printer is provided with: a retaining means to retain a photoconductive drum from the side of the inner circumferential face of the photoconductive drum at a flange located on the extraction side of the photoconductive drum; and an advance and retreat mechanism to advance and retreat the retaining means inside the photoconductive drum.

With the above configuration, it is possible to easily dismantle a retaining means together with a flange from a photoconductive drum by releasing the contact between the retaining means and the photoconductive drum by the operation of the advance and retreat mechanism and thereafter extracting the flange provided with the retaining means from the photoconductive drum when the photoconductive drum is dismantled. Consequently, it is possible to easily mount a retaining means together with a flange on a photoconductive drum by operation through the reverse procedure when the photoconductive drum is mounted.

DETAILED DESCRIPTION OF THE PREFERRED EMBODIMENTS

An embodiment of an electrophotographic printer according to the present invention is hereunder explained in reference to FIGS. 1 to 6.

Figure 1:
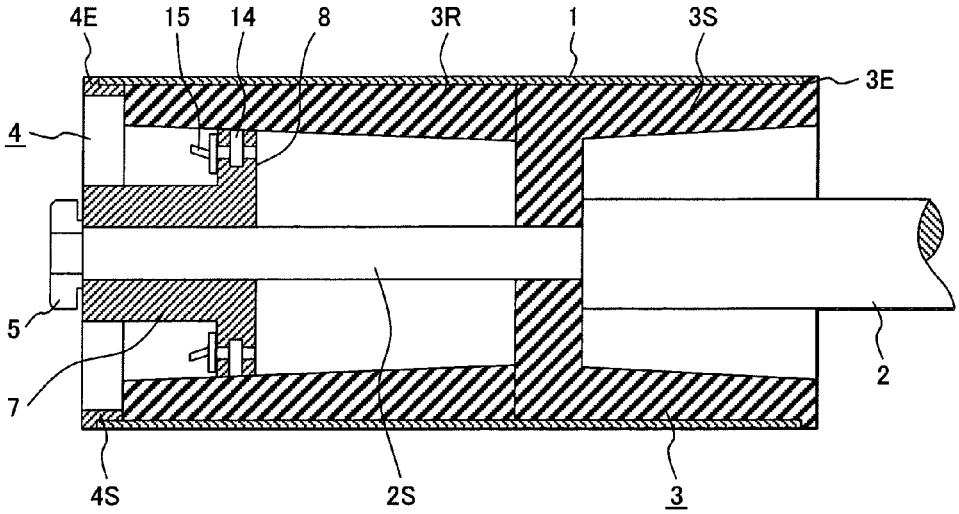
FIG. 1 is a vertical sectional view of a photoconductive drum showing the first embodiment of the present invention.

In FIG. 1, a photoconductive drum 1 is rotatably supported by a drive shaft 2 in a printer (not shown in the figures). A small diameter part 2S extends from the root of the drive shaft 2 toward the side where the photoconductive drum 1 is extracted. The outer circumference of a first flange 3 fixed to the step formed between the drive shaft 2 and the small diameter part 2S engages with an end part of the cylindrical photoconductive drum 1. More specifically, an outer circumferential part 3S is formed on the first flange 3. And the outer circumferential part 3S fits into the inner circumferential face of the photoconductive drum 1 and thereby contacts and supports the inner circumferential face of the photoconductive drum 1. Furthermore, an end part 3E of the outer circumference part 3S engages with an end of the cylindrical photoconductive drum 1 all over the circumference so that the photoconductive drum 1 may not move toward the axial support side of the drive shaft 2.

Figure 2:
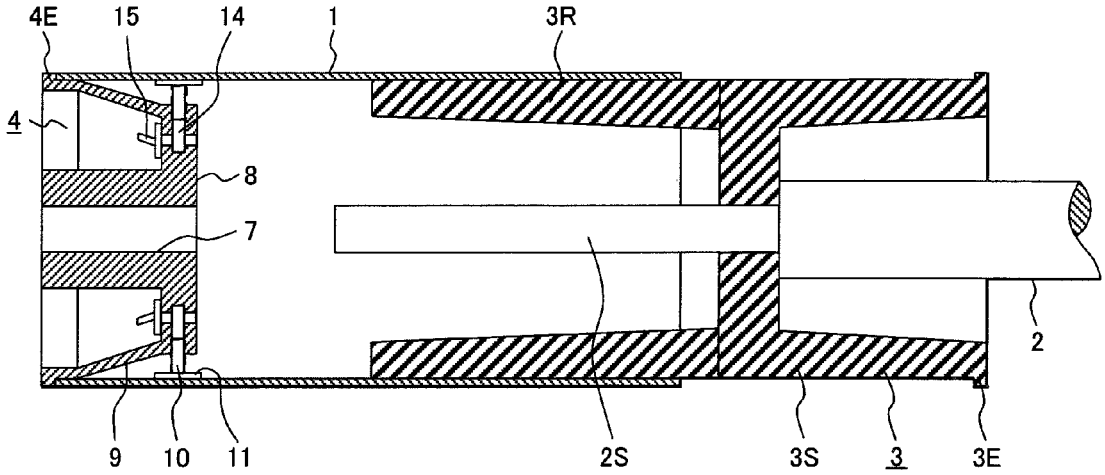
FIG. 2 is a vertical sectional view showing the photoconductive drum is on the way of extraction.
Figure 3:
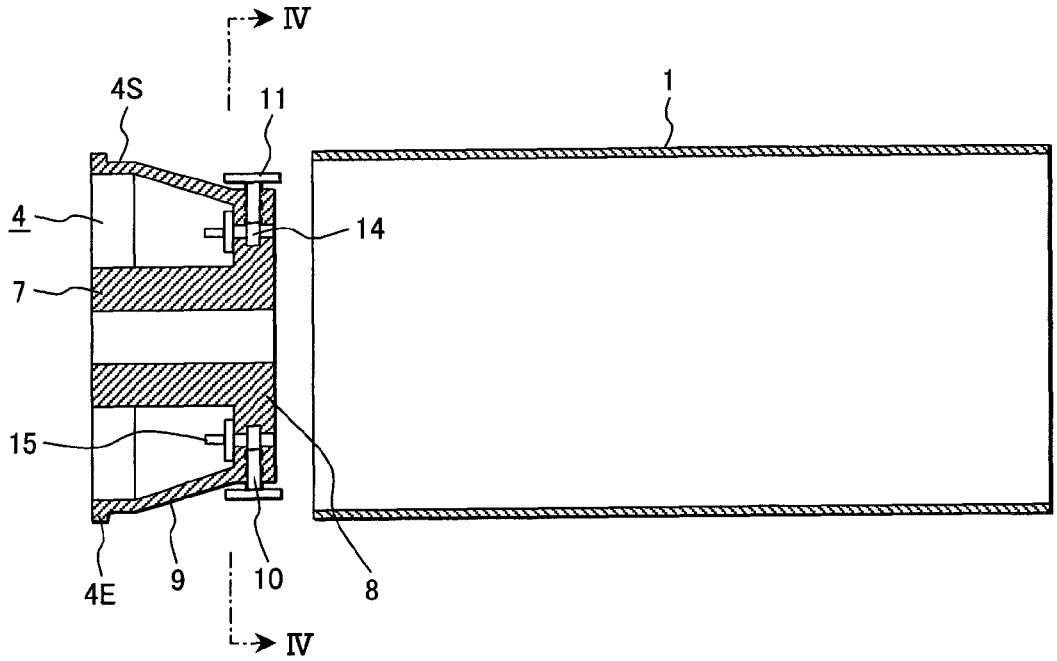
FIG. 3 is a vertical sectional view showing the flange on the extraction side is detached from the photoconductive drum.

In FIG. 1 and 2, the other end of the cylindrical photoconductive drum 1 engages with a second flange 4 attached to the small diameter part 2S in the manner of being attachable and detachable only in the axial direction. More specifically, the second flange 4 comprises a fixed part 7 attached to the small diameter part 2S in the manner of being attachable and detachable only in the axial direction. And plural retaining arms 8 is provided in the second flange 4 which extend from the fixed part 7 in the radial direction and retain the inner circumferential face of the photoconductive drum 1. A conical connecting tube 9 is provided which is extending from the retaining arms 8 toward the side where the photoconductive drum 1 is extracted. In FIG. 3, an annular shaped outer circumferential part 4S that is formed at an end of the connecting tube 9, fits into the inner circumferential face of the photoconductive drum 1. The outer circumferential part 4s contacts and supports the inner circumferential face of the photoconductive drum 1. And an annular shaped end part 4E is engaged with an end of the cylindrical photoconductive drum 1 all over the circumference. The annular shaped outer circumference part 4S and the end part 4E maybe connected directly to the fixed part 7 not through the connecting tube 9 but through another arm.

Then the photoconductive drum 1 is concentrically supported by the drive shaft 2 in the manner of being clamped and retained by the first flange 3 and the second flange 4 when the fixed part 7 is tightened by tightening means 5 such as a nut screwed at the end of the small diameter part 2S.

In addition, the first flange 3 is provided with plural ribs 3R that extend in the axial direction and have extended end parts located at positions close to the second flange at the time of tightening. The ribs 3R function as a guide means so that the photoconductive drum 1 may not contact peripheral devices when the photoconductive drum 1 is attached to or detached from the drive shaft 2.

In the meantime, it is important that: each of the outer circumference part 3S of the first flange 3 and the outer circumference part 4S of the second flange 4, those fitting into the photoconductive drum 1, has a conically shaped surface and the diameter of the conically shaped surface decreases toward the direction where said photoconductive drum is clamped. Accordingly, no gap maybe formed between the outer circumference parts 3S and 4S and the photoconductive drum 1 at the time of fitting. In other words, when the first flange 3 and the second flange 4 are tightened with the tightening means 5, and thereby print quality is prevented from deteriorating due to the eccentricity of the photoconductive drum 1 caused by the formed gap.

In FIG. 3 to FIG. 6, addition, each of the retaining arms 8 includes a rod 10 retained movably forward and backward in the radial direction and a retaining seat 11 is disposed at a tip of the rod 10. A friction member 12 made of rubber material or the like is disposed on the retaining seat 11 on the side contacting the inner circumferential face of the photoconductive drum 1 in order to ensure the retaining of the photoconductive drum 1. Further, a resilient means such as a tension spring 13 is placed around the rod 10 in order to give the retreating force of the retaining seat 11. And each of the retaining arms 8 has an eccentric cam 14. The eccentric cam 14 has the function of advancing and retreating the rod 10 to and from the photoconductive drum 1. Here, the retaining seat 11 works as a contacting member which contacts the inner circumferential face of the photoconductive drum 1 according to the present invention. Then the eccentric cam 14 acts as a contacting force adjusting means to adjust the contacting force of the contacting member against the photoconductive drum.

Here, the retaining means according to the present invention comprises the retaining arms 8, the rods 10, and the retaining seats 11, and the advance and retreat mechanism. The mechanism advances and retreats the retaining means to and from the inner circumferential face of the photoconductive drum which comprises the tension spring 13, the eccentric cams 14 and the handles 15.

Successively, operations for changing the photoconductive drum 1 are explained.

Figure 5:
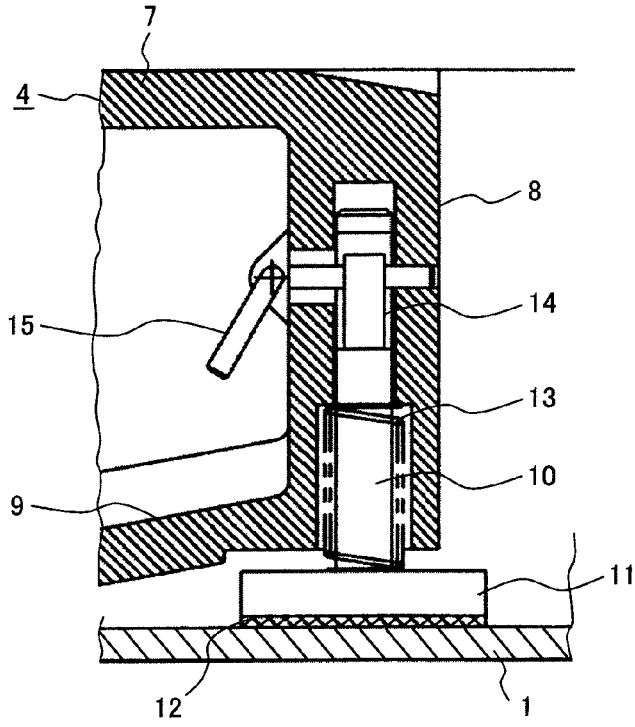
FIG. 5 is a enlarged vertical sectional view showing the flange on the extraction side is attached to the inner circumferential face of the photoconductive drum.

Now the photoconductive drum 1 mounted in a printer is retained on the drive shaft 2 by the clamping force between the first flange 3 and the second flange 4 as shown in FIG. 1. On this occasion, each of the retaining arms 8 presses a retaining seat 11 to the inner circumferential face of the photoconductive drum 1 with an eccentric cam 14 against the tension of a tension spring 13 as shown in FIG. 5. When the photoconductive drum is detached from the printer in this state, it is possible to extract the photoconductive drum 1 outside the printer as shown in FIG. 2 by firstly loosening and detaching the tightening means 5 in the state shown in FIG. 1 and thereafter pulling and extracting the first flange 4 while the ribs 3R of the first flange 3 are used as guides and the photoconductive drum 1 does not contact the peripheral devices.

Successively the second flange 4 is detached from the photoconductive drum 1 extracted outside the printer. The second flange 4 is detached from the drum 1 by extending a hand into the opening side of the connecting tube 9 and rotating the handle 15 disposed on each of the retaining arms 8.

Figure 6:
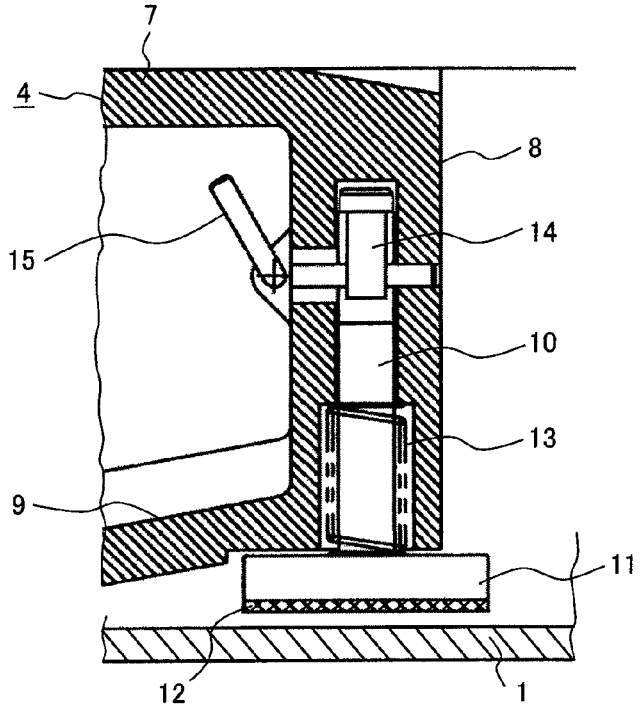
FIG. 6 is a enlarged vertical sectional view showing residing immediately before the flange on the extraction side is detached from the inner circumferential face of the photoconductive drum.

The pressing force of each rod 10 caused by each eccentric cam 14 is released by the rotation of the handle 15 as shown in FIG. 6. When the pressing force of each rod 10 is released, each retaining seat 11 is separated from the inner circumferential face of the photoconductive drum 1 by the retracting force of the tension spring 13. The retaining arms 8 can also be extracted simultaneously as shown in FIG. 3 by holding the second flange 4 and extracting from the photoconductive drum 1 in this state.

Thereafter, when a new photoconductive drum 1 is attached to the printer, the second flange 4 engages with an end of the new photoconductive drum 1 as shown in FIGS. 2 and 3. By the rotation of the handle 15, the retaining seat 11 is displaced to the side of the photoconductive drum 1 as shown in FIG. 5 by the pressing force of the rod 10 caused by the eccentric cam 14. And the retaining seat 11 is pushed to the inner circumferential face of the photoconductive drum 1. The second flange 4 is fixed again to the end of the photoconductive drum 1 on the extraction side.

Successively, the second flange 4 is held and the photoconductive drum 1 is attached to the printer while being guided by the ribs 3R of the first flange 3 as shown in FIG. 2. Thereafter the tightening means 5 is attached to the small diameter part 2S, the attached photoconductive drum 1 is tightened, and thereby the photoconductive drum 1 is concentrically fixed to the drive shaft 2 by the clamping force between the first flange 3 and the second flange 4 as shown in FIG. 1.

In the meantime, it is possible to increase or decrease the force for pushing a retaining seat 11 to the inner circumferential face of the photoconductive drum 1 by changing the rotation angle of a handle 15, in other words by changing the rotation position of an eccentric cam 14.

Here, although the above embodiment is the case where a tension spring 13 is disposed on each retaining arm 8 and tension is always imposed on each retaining seat 11 in the manner of separating from the photoconductive drum 1, it is also possible to impose pressing force to always push each retaining seat 11 on the side of the photoconductive drum 1 with a compression spring in place of the tension spring 13. On this occasion however, it is necessary to adopt a mechanism for pulling back each rod 10 in the direction of separating from the inner circumferential face of the photoconductive drum 1 with each eccentric cam 14 within the rotation range of each handle 15.

Consequently, the tension spring 13 or the compression spring, which corresponds to the spring means of the invention. The retaining means including the spring means contacts the inner circumferential face of a photoconductive drum according to the embodiment.

As explained above, in the present embodiment, since the photoconductive drum 1 is configured so as to be attachable to and detachable from the retaining arms 8 even by simple rotating operation of the handles 15, it is not necessary for each photoconductive drum 1 to have its own disposable retaining arms 8.

Note that, the weight of the photoconductive drum 1 is about 5 kg and hence it is necessary to surely hold the photoconductive drum 1 with both hands at the attaching and detaching operation also from the viewpoint of safety.

Figure 4:
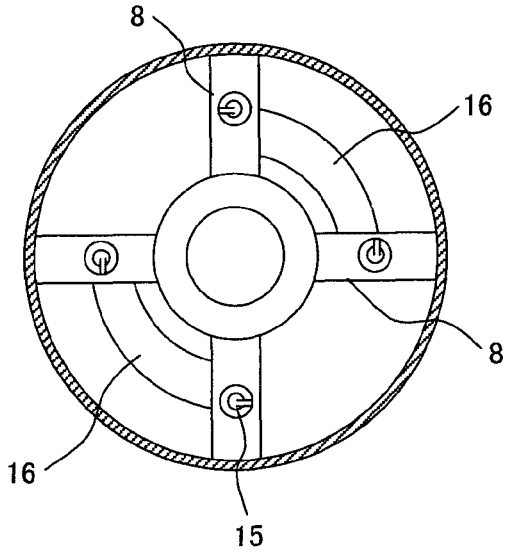
FIG. 4 is a sectional view taken on line IV-IV of FIG. 3.

To that end, it is possible to facilitate the attaching and detaching operation and handle the photoconductive drum 1 safely during the attaching and detaching operation and after the detaching from a printer. It can be achieved by disposing arcuate handles 16 in the manner of connecting adjacent retaining arms 8 with each other as shown in FIG. 4.

Figure 7:
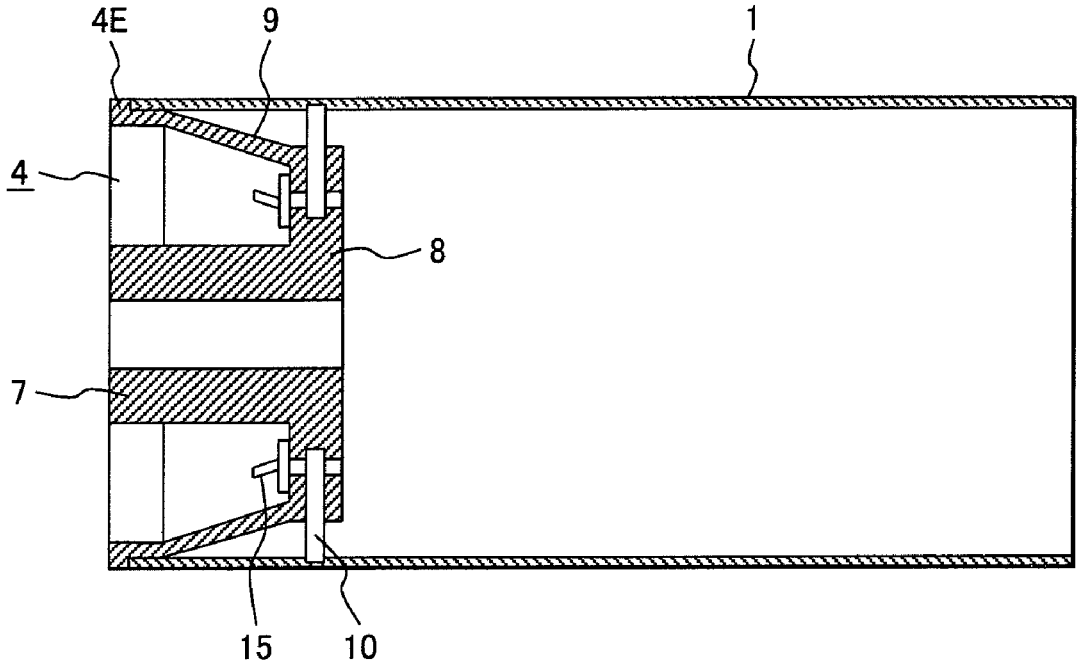
FIG. 7 is a vertical sectional view showing a second embodiment where the flange on the extraction side is attached to the inner circumferential face of the photoconductive drum.
Figure 8:
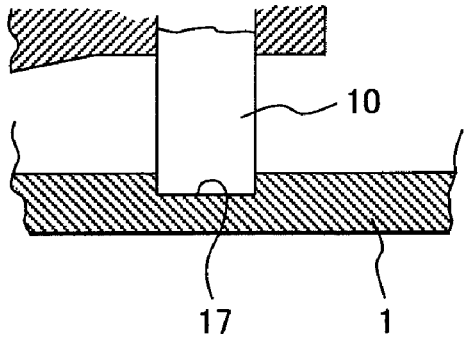
FIG. 8 is an enlarged vertical sectional view showing a substantial part in the view shown in FIG. 7.
Figure 9:
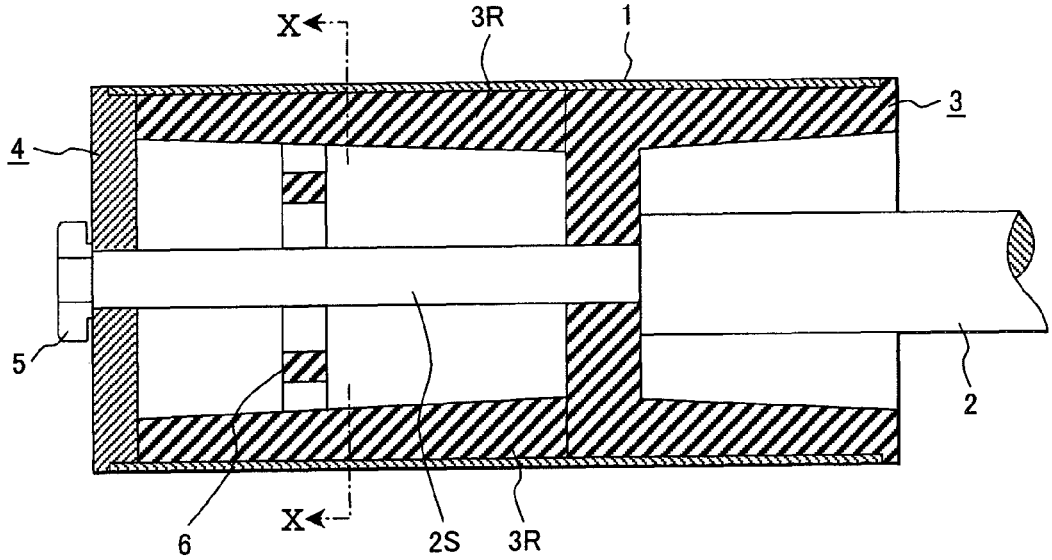
FIG. 9 is a vertical sectional view showing a conventional photoconductive drum and corresponding to FIG. 1.
Figure 10:
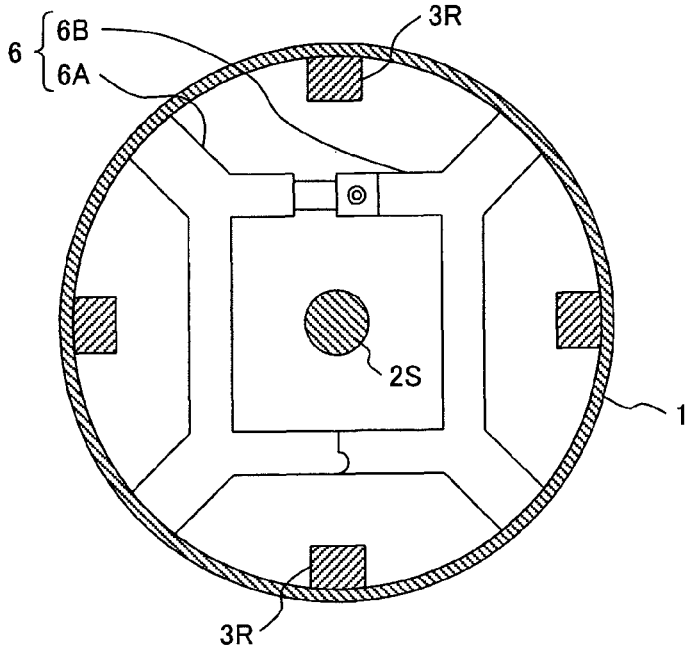
FIG. 10 is a vertical sectional view taken on line X-X of FIG. 9.

As a modified example, it is also possible to form engaging grooves 17, in place of the friction members 12, on the inner circumferential face of the photoconductive drum 1 which the rods 10 contact as shown in FIGS. 7 and 8. And thereby make the rods 10 engage with the engaging grooves 17. Here, when the relative position of the second flange 4 in the circumferential direction of the photoconductive drum 1 is not specified, an engaging groove 17 is formed all around the inner circumferential face of the photoconductive drum 1.

Further, the rods 10 may engage or disengage with the engaging grooves 17 by rotating the handles 15 and thereby directly advancing or retreating the rods 10, or by advancing or retreating the rods 10 through eccentric cams or the like.

In the above modified example too, the same effects can be obtained with nearly the same operations as the aforementioned embodiment.

What is claimed is:

1. An electrophotographic printer, comprising:

a cylindrical photoconductive drum having photosensitivity;

a first flange engaging with an end of said cylindrical photoconductive drum and being supported by a drive shaft of the printer;

a second flange engaging with the other end of said cylindrical photoconductive drum and being supported by said drive shaft, and a tightening means to concentrically fix said photoconductive drum to said drive shaft by pressurizing said second flange toward the side of said first flange through the tightening means, wherein said second flange includes a retaining means configured so as to retain an inner circumferential face of said photoconductive drum and be able to advance to and retreat from the inner circumferential face.

2. An electrophotographic printer, comprising:

a cylindrical photoconductive drum having photosensitivity;

a first flange engaging with an end of said cylindrical photoconductive drum and being supported by a drive shaft of the printer;

a second flange engaging with the other end of said cylindrical photoconductive drum and being supported by said drive shaft, and a tightening means to concentrically fix said photoconductive drum to said drive shaft by pressurizing said second flange toward the side of said first flange through the tightening means, wherein said second flange includes:

a retaining means configured so as to retain the inner circumferential face of said photoconductive drum; and an advance and retreat mechanism to advance and retreat said retaining means to and from the inner circumferential face of said photoconductive drum.

3. An electrophotographic printer according to claim 2, wherein said retaining means is involving a resilient means configured to advance and to retreat the retaining means to the inner circumferential face of said photoconductive drum.

4. An electrophotographic printer according to claim 2 , wherein said retaining means has a contacting member to contact the inner circumferential face of said photoconductive drum, and is provided with a contacting force adjusting means to adjust the contacting force of said contacting member against said photoconductive drum.

5. An electrophotographic printer according to claim 3, wherein said retaining means has a contacting member to contact the inner circumferential face of said photoconductive drum, and is provided with a contacting force adjusting means to adjust the contacting force of said contacting member against said photoconductive drum.

6. An electrophotographic printer according to claim 5, wherein said contacting force adjusting means is configured so as to adjust the resilient force of said resilient means.

7. An electrophotographic printer, comprising:

a cylindrical photoconductive drum having photosensitivity;

a first flange engaging with an end of said cylindrical photoconductive drum and being supported by a drive shaft of the printer;

a second flange engaging with the other end of said cylindrical photoconductive drum and being supported by said drive shaft, and a tightening means to concentrically fix said photoconductive drum to said drive shaft by pressurizing said second flange toward the side of said first flange through the tightening means, wherein said first flange includes an outer circumferential part to retain the inner circumferential face of said photoconductive drum and an end of the outer circumference part engaging with an end of the cylindrical photoconductive drum all over its circumference;

said second flange is provided with a fixed part supported by said drive shaft, plural retaining arms extending from the fixed part in the radial direction and retaining the inner circumferential face of said photoconductive drum, a connecting member extending from the retaining arms to the side where said photoconductive drum is extracted, an outer circumferential part being formed at the extending end of said connecting member and retaining the inner circumferential face of said photoconductive drum, and an end engaging with the end on the side where said photoconductive drum is extracted;

and also said retaining arms includes rods advancing to and retreating from the inner circumferential face of said photoconductive drum, retaining seats formed at the tips of said rods, and an operation part to advance and retreat said rods.

8. An electrophotographic printer according to claim 7, wherein each of said retaining seats is pressed with resilient force at the time of contacting the inner circumferential face of said photoconductive drum.

9. An electrophotographic printer according to claim 7, wherein:

each of the outer circumferential parts of said first flange and said second flange to retain the inner circumferential face of said photoconductive drum has a conically shaped surface.

10. An electrophotographic printer according to claim 7, further comprising:

a contacting force adjusting means which adjusts the contacting force of the retaining seat to the inner circumference face of the retaining seat to the inner circumferential face of said photoconductive drum, and a handling means rotatably provided on the operation part to change the position of the retaining seat according to the rotating angle.

11. An electrophotographic printer according to claim 2 or 7, wherein:

the retaining means comprises a retaining seat and a friction member disposed on the retaining seat.

12. An electrophotographic printer according to claim 2 or 7, wherein:

plural ribs provided on the first flange and extending in the axial direction and have extended end parts located at positions close to the second flange at the time of tightening.

13. An electrophotographic printer according to claim 7, wherein:

an arcuate handles disposed in the manner of connecting the adjacent retaining arms with each other.

* * * * *